United States Patent [19]

Cvijanovich et al.

[11] Patent Number: 4,832,798

[45] Date of Patent: May 23, 1989

[54] METHOD AND APPARATUS FOR PLATING COMPOSITE

[75] Inventors: George B. Cvijanovich; Richard T. Williams, both of Winston-Salem; Jeff C. Wu, Clemmons, all of N.C.

[73] Assignee: AMP Incorporated, Harrisburg, Pa.

[21] Appl. No.: 133,779

[22] Filed: Dec. 16, 1987

[51] Int. Cl.[4] ..... C25D 5/02

[52] U.S. Cl. ..... 204/15; 204/29; 204/37.1; 219/121.66; 427/53.1

[58] Field of Search ..... 204/15, 29, 37; 427/53.1; 219/121 LF, 121 LN

[56] References Cited

U.S. PATENT DOCUMENTS

| | | | |
|---|---|---|---|
| 4,348,263 | 9/1982 | Draper et al. | 204/29 |
| 4,432,855 | 2/1984 | Romankiw et al. | 204/207 |
| 4,674,176 | 6/1987 | Tuckerman | 29/591 |

OTHER PUBLICATIONS

AMP Engineering Note—AMP-Duragold Plating, pp. 1-7.

*Primary Examiner*—John F. Niebling
*Assistant Examiner*—William T. Leader
*Attorney, Agent, or Firm*—William B. Noll; Robert W. Pitts

[57] ABSTRACT

A method and apparatus for improving the integrity of metal plated composites is disclosed. Plating improvements are achieved by first irradiating a nickel plated substrate, prior to application of a noble metal plating layer, to smooth any surface discontinuities or irregularities. Excimer laser pulses, having a duration of less than 100 nanoseconds, are employed to partially liquefy the upper surface of the nickel plating on the substrate. This invention is compatible with conventional plating processes, such as electroplating.

3 Claims, 4 Drawing Sheets

46
40
44
42
36f
36e
36d
36c
36b
36a
34b
34a
38
32
50
60
70a
70b
70c
70d
70e
70f
70g
70h
90
80

METHOD AND APPARATUS FOR PLATING COMPOSITE

FIELD OF THE INVENTION

The invention relates to apparatus, and to the method for using same, for laser treating, then plating a composite, where said composite comprises an electrically conductive metal having a predetermined level of spring characteristics with a layer of nickel thereover.

DESCRIPTION OF THE PRIOR ART

Many industrial applications require the use of a noble metal plating over a base metal to resist the effects of corrosion and surface contamination due to the exposure of such base metal to certain environmental conditions. One of the most important specific instances in which a noble metal plating must be employed is in conjunction with electrical terminals which interconnect various electrical components. Many conventional electrical components employ an electrically conductive metal contact, where such metal possesses certain spring characteristics, with the electrical interconnection being maintained by the engagement of the contacts through reliance on such spring characteristics. However, in order to maintain a satisfactory electrical connection in the presence of corrosion or contamination of the electrical contact terminals, a noble metal plating must often be applied to the surface of the base metal. Quite commonly, a gold or gold alloy plating is applied over a copper or copper alloy electrical terminal. In order to prevent intermetallic diffusion of the copper or copper alloy into the gold or gold alloy, an intermediate nickel layer is conventionally employed.

Even though gold plating provides a suitable mechanism for maintaining a high quality electrical contact, the porosity of the gold plating must be low to prevent exposure of the base metal to corrosive substances which, over time, will destroy the integrity of the electrical connection. One means of controlling the porosity of gold plating is to inure that any gold or gold alloy layer is sufficiently thick. Of course, the additional gold results in an added expense. Thus, one challenge facing the workers in the art is to achieve a compromise between the amount of expensive gold which should be used to maintain the integrity of the plated electrical terminal, and the extent to which such expense may be eliminated by reducing the thickness of the gold layer.

U.S. Pat. No. 4,348,263 is directed to the improvement of macroscopic surface roughness of features, on the order of ten micrometers, of electrical components, such as switch contacts, integrated surface contacts, relay contacts, and printed circuit board contacts having a copper alloy substrate, by melting the substrate with radiant energy. In addition to changing the macroscopic surface characteristics, microscopic structural changes on the order of less than ten micrometers were found to reduce grain size to reduce diffusion of the substrate base layer through a plating layer. Gold, which has been electroplated over copper alloys prepared by the technique described in U.S. Pat. No. 4,348,263, has shown improved resistance to sulfur and chlorine corrosion. Continuous wave lasers can be moved across the surface to produce melting or a pulsed radiation beam. Typically a Q-switched neodymium yttruim aluminum garnet (YAG) laser was used. According to such patent, for a nickel substrate, a melt time of ten milliseconds was found to result in a maximum melt depth of 0.1 millimeters, while a melt time of five microseconds resulted in a maximum melt depth of 2.5 micrometers. The duration of laser pulses employed in the technique described in U.S. Pat. No. 4,348,263 is generally on the order of microseconds, but in any event is less than ten milliseconds.

For electrical contacts which are dependent upon the spring characteristics of the base metal, excessive exposure to the heat produced by microsecond laser pulses can anneal the spring metal substrate, thus resulting in a degradation of the spring properties of the substrate. Such a problem is the result of the system described and claimed in U.S. Pat. No. 4,432,855. Specifically, such system includes means for laser plating followed with laser heating of the placed substrate to work the metal deposited by heating; and the work is followed by the energy beam during heat treatment to provide tempering or annealing. Thus, this system changes the metallurgical properties of the metal substrate.

It would follow from this, that if the effects of laser irradiation can be confined to a thin or superficial layer at the surface of the material to be plated with a noble metal, an acceptable spring electrical contact, having an improved plating, can be achieved without deleteriously affecting the spring characteristics thereof. Preferably the effects of laser irradiation should be confined to intermediate platings, such as nickel employed between the surface of spring metal substrate and noble metal platings.

The instant invention is specifically directed to an apparatus and method which permits a significant reduction in the thickness of a gold plating layer without a commensurate degradation in the porosity of the gold plating layer. Improvement in the use of gold plating is achieved by reducing the surface irregularities of an intermediate nickel plating.

SUMMARY OF THE INVENTION

This invention is directed to an improved apparatus and method for surface treating and plating a noble metal layer onto a metal composite substrate, where the untreated surface is characterized by surface discontinuities. The substrate can comprise a continuous strip of base metal stock or a continuous elongate strip of discrete electrical terminals joined by a continuous carrier. This method and apparatus is especially suitable for continuous surface treating and plating operation. In the preferred practice of this invention, the substrate is provided with an intermediate plating layer, either deposited as a part of the same continuous operation or previously deposited on the base metal stock. In such a continuous operation, the continuous substrate is moved first through a first position or station and then subsequently through a second position or station. At such first station, the substrata is irradiated by a laser. Although the entire substrate may be irradiated in this manner, this invention is especially adapted to cleaning, polishing, smoothing, or reflowing selected portions of the intermediate plated base metal stock which would correspond to contact interfaces of electrical terminals. When the laser irradiated portion of the substrate is moved from the first to the second station the irradiation portions can then be plated by a conventional manner, but the thickness of the noble metal layer will be reduced without compromising the porosity of the plating. In the preferred embodiment of this invention, the laser is pulsed at a relatively low level and the duration is in the order of nanoseconds, such that only the intermediate plated layer is affected by the laser energy. The intensity of the laser radiation is, however, sufficient to reflow and smooth the surface to be plated. In this manner, a uniform noble metal plating layer, such as gold, can be achieved in microscopic or macroscopic crevices in the substrate, which could form a sink for the noble metal plating.

BRIEF DESCRIPTION OF THE DRAWINGS

FIG. 3 illustrates the manner in which a continuous strip of electrical terminals can be first subjected to laser irradiation and subsequently plated with a noble metal in any of a number of conventional noble metal plating operations.

DETAILED DESCRIPTION OF THE PREFERRED EMBODIMENT

Figure 1:
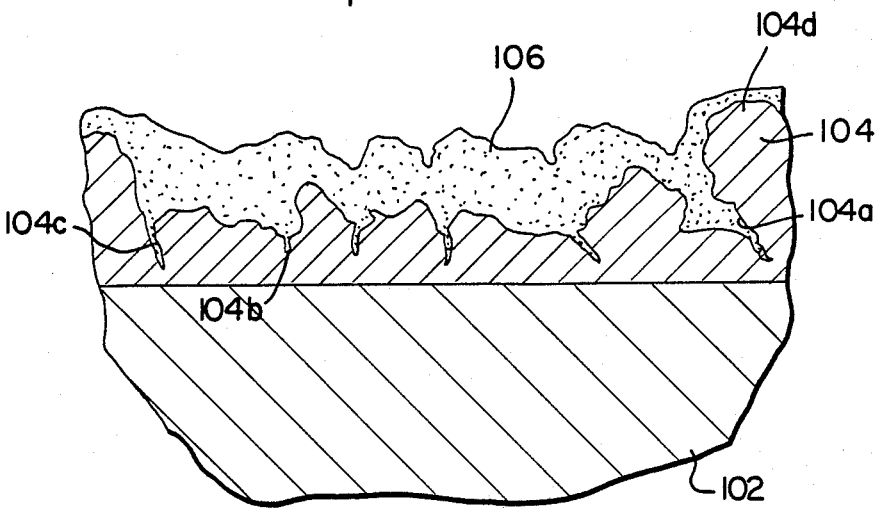
FIG. 1 PRIOR ART
FIG. 1 is a simulated microscopic sectional view of a prior art multi-layered composite.

FIG. 1 shows an artistic rendition of a simulated microscopic two-layer plated substrate prepared by the use of conventional prior art techniques. As shown in FIG. 1, a substrate 102, which could comprise a base metal such as copper or copper alloy, has been provide with an intermediate plating 104 on at least one surface of the substrate 102. A second outer plating layer 106 is then deposited over the intermediate plating 104. FIG. 1 is representative of the contour which is achievable through the use of conventional electroplating processes to first deposit a nickel intermediate substrate 104 on a copper or copper alloy substrate 102. Note that by using conventional techniques, the surface of the intermediate or nickel substrate 104 is quite irregular and contains a number of surface discontinuities such as crevices or gaps 104*a*, 104*b*, and 104*c* and a number of protruding sections such as illustrated as 104*d*. The surface irregularities are often increased by abrasion or scratching. The use of strip stock in continuous plating can result in scratching and abrasion of a nickel plating. By such conventional techniques, when an outer plating layer 106 is deposited over an intermediate layer 104, the crevices 104*a*, 104*b* and 104*c* must first be filled with the plating material, then a sufficient thickness must be applied over protrusions, such as 104, in order to insure adequate performance by the noble metal layer 106. For this reason, the thickness of the noble metal plating layer 106 must be greater than would be necessary if the noble metal plating were applied to a smoothed surface without significant surface discontinuities.

Figure 2A:
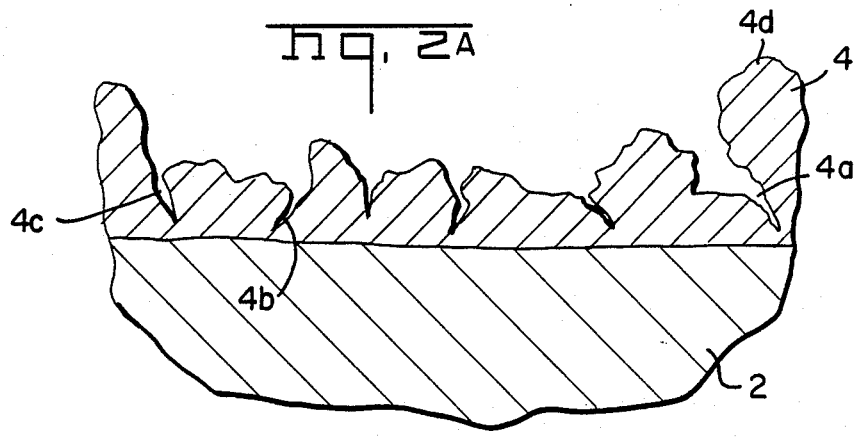
FIGS. 2*a*, 2*b*, and 2*c* are sectional views similar to FIG. 1 but illustrating laser irradiation of an intermediate plating layer and the deposition of a subsequent noble metal plated layer as practiced by this invention.
Figure 2B:
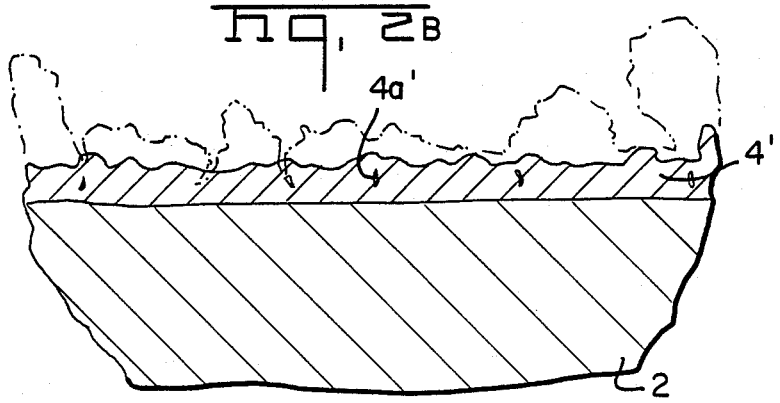
Figure 2C:
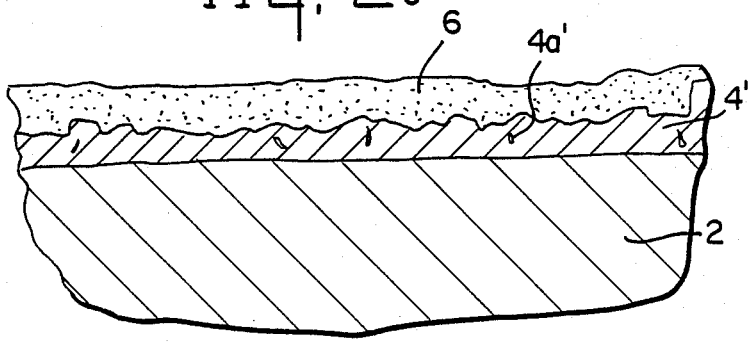
Figure 7:
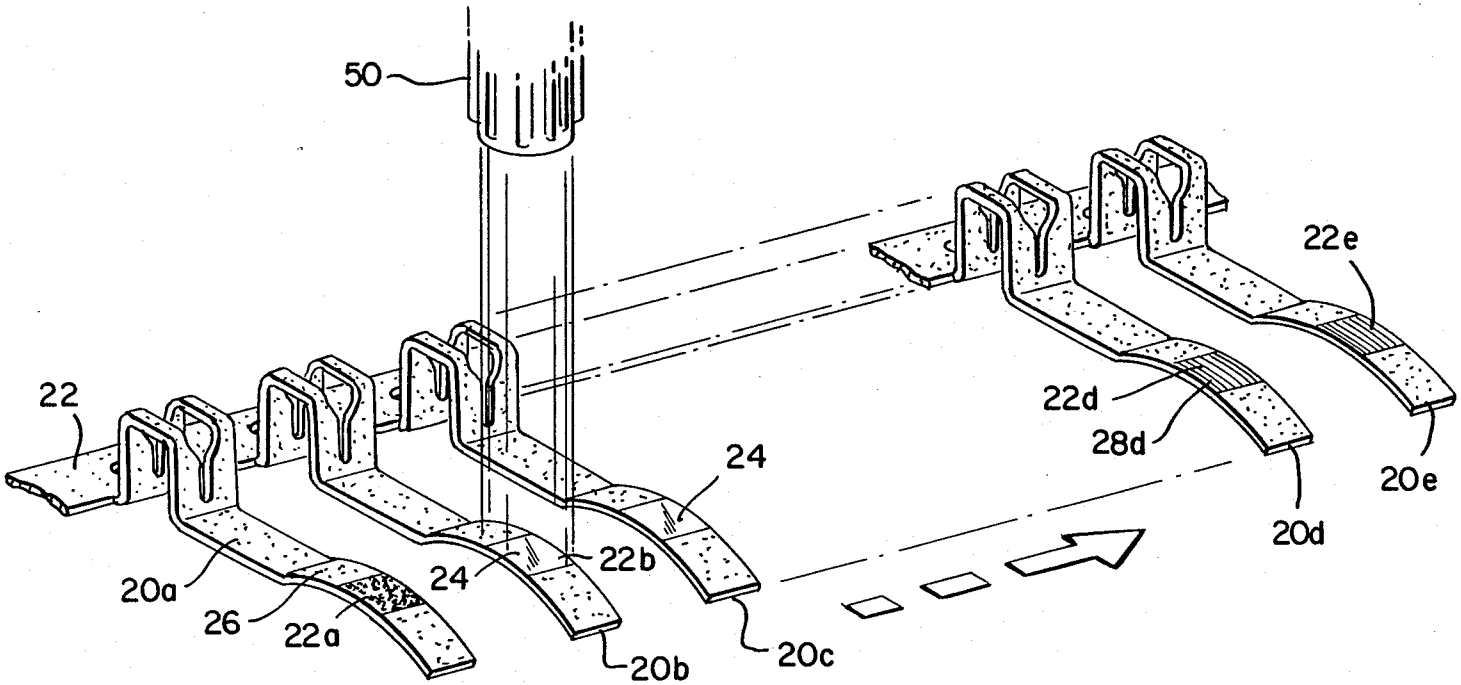

FIGS. 2*a*, 2*b* and 2*c* demonstrate the manner in which the present invention can be employed to first smooth, polish or reflow the intermediate plating layer so that a smaller volume of noble metal plating can be employed while achieving the same performance. FIG. 2*a* shows an intermediate plating layer 4 which is identical to the intermediate plating layer 104 shown in FIG. 1. Upon subjecting the intermediate plating layer 4 to the radiation from an excimer laser, as shown in FIG. 2*b*, the surface discontinuities, such as crevices 4*a*, 4*b*, and 4*c* and protrusions 4*d*, as shown in FIG. 2*a*, are smoothed by reflow in at least the upper portion of the intermediate plating layer 4. The reflowed plating layer 4' does not contain the same degree of surface discontinuities exhibited by the layer 4*a* in FIG. 2*a*. Furthermore, some of the pores or crevices 4*a'* have been sealed by the reflow or polishing step. Excimer lasers, as described herein, are a group of pulsed high-pressure gas lasers which emit at four wavelengths, varying between 193 nm and 351 nm, in the ultraviolet spectral region. For a more complete discussion thereof, reference is made to an article by Herbert Pummer in the Proceedings of the SPIE—The International Society for Optical Engineering, Vol. 610, January 21–24, 1986.

It has been discovered that the surface discontinuities can be removed, smoothed, or sufficiently reduced by liquefying only the upper portion of the intermediate plating 4. Sufficient energy can be delivered to the surface in a controlled manner by irradiating the plated surface with a very short laser pulse, without significantly affecting the base metal properties, such as by annealing or tempering. For example, it has been discovered that a nickel plated substrate can be exposed to a single pulse of excimer UV laser radiation to adequately smooth the nickel surface for the suitable reception of a thin gold plated layer.

Conventional nickel platings have a thickness on the order of between 50–100 microinches (1.27–2.54 micrometer). By confining the melting and resolidification due to laser irradiation to the thin outer layer of the Ni plating, for example the outer 40 microinches (1 micrometer), the spring characteristics of the underlying material will not be adversely affected, because the underlying substrate will not be raised to a high, property modifying temperature. The main requirements for surface polishing or cleaning in this manner are high peak power in a short pulse (less than 100 nanoseconds) to limit the melt depth, moderately high average power (greater than 60 watts) to achieve throughput for a continuous process, and a wavelength that couples efficiently to the intermediate plating, which in the preferred case is nickel. $CO^2$ lasers exhibit a poor coupling of infrared radiation to metals and a low average power. A KrF excimer laser delivers short pulses on the order of 20 nanoseconds at peak power and average powers that are suitable for polishing. The excimer laser output is ultraviolet, which couples effectively to nickel metal. Nanosecond heating and cooling rates are important to prevent annealing of the underlying spring metal. Use of a Nd:YAG laser would require significant compromise. Use of an excimer laser will allow a polishing rate commensurate with continuous plating speeds of 40 ft./min. at 60 watts average power.

The noble metal plating layer, which could be a gold layer, or a palladium layer 6, can be deposited over the smoothed or reflowed intermediate plating layer 4' by any number of conventional means. For example, the outer protective plating layer can be applied by a conventional electroplating process, by an arc spraying process, or by a number of different laser deposition techniques.

Figures 4, 4A, 4B:
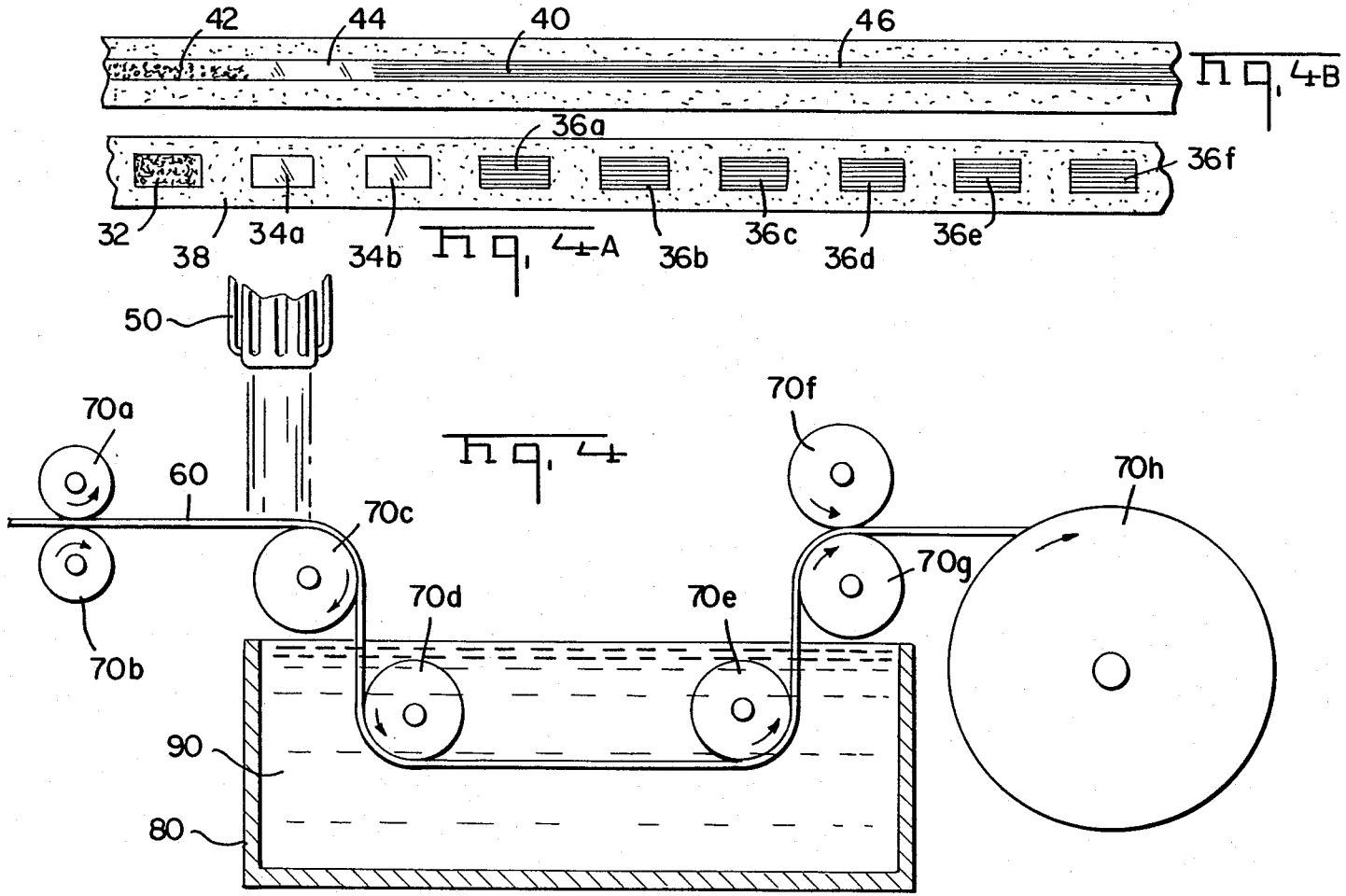
FIG. 4 shows a continuous selective plating operation in which selected areas are plated using a conventional electroplating process.
FIGS. 4*a* and 4*b* are top views of continuous strips in alignment with the stages of the plating process shown in FIG. 4.

FIGS. 3 and 4 demonstrate the manner in which this improved plating process can be implemented on a continuous basis using any number of these conventional plating processes. In FIG. 3, a continuous elongate strip of electrical terminals can be continuously moved through a plating operation incorporating the essential elements of this invention. The discrete electrical terminals 20 are joined to a continuous carrier 22. Terminals 20 are intended to be merely representative of the general type of discrete electrical terminals which could be selectively plated using the method described herein. Each of the terminals 20 has a spring member 26 having a principal contact area 22 in which the nickel plating is initially exposed. For example, on terminal 20*a*, the nickel plating is exposed in the contact area 22*a* of a flexible beam 26.

FIG. 3 shows a selective plating process in which a large portion of the terminal is covered with a conventional mask which will prevent the deposition of an outer noble metal plating on the contact in a conventional plating process. As shown in FIG. 3, the contact area 22*a*, in which the nickel plating is exposed, is subjected to laser radiation from laser 50. Terminal 20*b* is shown in a first position or station at which the laser 50 is focused. As the carrier strip 22 moves the terminals through this first station, the contact in the position occupied by terminal 20*b* is subjected to a laser pulse prior to the plating process. Terminal 20*c*, shown downstream of the first station, has a nickel plating which is smooth and has been cleaned by the laser pulse. The terminals can then be immediately moved into a conventional plating process in which a noble metal plating can be deposited over the area 22. Terminals 20*d* and 20*e*, shown emerging, after having been advanced through the plating operation, have a gold plated layer on the contact surface 20*d* and 20*e*.

FIG. 4 demonstrates the manner in which this process is suitable for use with a conventional wet electroplating process in which a continuous strip is passed through the wet plating tank. It should be understood, of course, that the tank 80 and the plating solution 90 shown in FIG. 4 are intended to be representative of any of a number of known and conventional plating processes. As shown in FIG. 4, the continuous strip 60 is advanced by a series of feed rollers 70*a* through 70*g*. As the strip 60 passes through feed rollers 70*a* and 70*b*, the surface of the strip would be exposed in the area to be plated. In the preferred embodiment of this invention, this exposed surface would be nickel plated. At a first station prior to the electroplating process, the nickel coated portion of the terminal is subjected to a pulse of laser radiation to reflow or smooth the surface in the manner previously described. The continuous strip is then moved through the plating solution 90 in tank 80 and is subsequently taken up on a reel 70*h*.

FIGS. 4*a* and 4*b* demonstrate two types of selective plating processes which can be performed using this invention. As shown in FIG. 4*a*, discrete discontinuous segments of a continuous strip 30 are plated. A mask 38 covers those portions of the continuous strip which need not be plated. The initially unmasked nickel plating is reflowed as it passes through the first laser irradiation position or station and is subsequently gold plated as it passes through the second station or electroplating step. FIG. 4*b* shows the manner in which a continuous strip may be electroplated. The unmasked nickel 42 can be polished or smoothed to form a surface 44 which is then plated with a noble metal plating at 46. This strip can be continuous even with a pulsed laser since the timing of the laser pulses can be chosen so that the subsequently irradiated portions overlap. Note that both FIGS. 4*a* and 4*b* are shown in axial alignment with the plating process shown in FIG. 4.

It should, of course, be understood that this invention is not limited to use with a gold over nickel plating as described with reference to the preferred embodiment of this invention. The invention can be employed with tin plating or the use of other noble metals such as palladium. Furthermore, the invention serves to remove contaminants and clean the surface of the substrate in addition to smoothing the surface. Although the principal use of the invention is believed to be in conjunction with the deposition of electrically conductive metallic platings, it should be understood that other coatings or platings might be deposited in a similar fashion. Furthermore, this invention is in no way intended to be limited to its use with electrical terminals as described in the preferred embodiment of this invention, as other applications may be apparent to one of ordinary skill in the art.

I claim:

1. A method of improving the surface characteristics of a metal plated composite, where said composite consists of an electrically conductive metal having a predetermined level of spring properties, and a layer of nickel thereover, where said nickel layer is characterized by a high degree of surface discontinuities, comprising the steps of (a) subjecting selected areas of said nickel layer to a controlled amount of irradiation consisting of a short pulse from an excimer laser operating at an ultraviolet wavelength to cause a reflowing of such selected areas to reduce said surface discontinuities, where said controlled amount of irradiation is less than that required to substantially affect the spring properties of said metal substrate, and (b) plating said irradiated nickel layer with a layer of a metal selected from the group consisting of gold, palladium, and tin.

2. The method according to claim 1 wherein said laser irradiation comprises laser pulses of less than 100 nanoseconds, at an average power greater than 60 watts.

3. The method according to claim 1 wherein said plating metal is gold.

* * * * *